United States Patent [19]

Rohde

[11] 4,214,843

[45] Jul. 29, 1980

[54] SUBSEA GROUT DISTRIBUTOR

[75] Inventor: Heinz K. Rohde, Houston, Tex.

[73] Assignee: Brown & Root, Inc., Houston, Tex.

[21] Appl. No.: 759

[22] Filed: Jan. 3, 1979

[51] Int. Cl.[2] ..... E02B 17/02

[52] U.S. Cl. ..... 405/225; 405/224; 405/227; 405/203

[58] Field of Search ..... 405/195–209, 405/224–227; 175/5–10; 166/285, 338

[56] References Cited

U.S. PATENT DOCUMENTS

| | | | |
|---|---|---|---|
| 3,492,824 | 2/1970 | Evans et al. | 405/303 |
| 3,823,564 | 7/1974 | Crout et al. | 405/224 X |
| 3,878,687 | 4/1975 | Tragesser | 405/225 |
| 4,009,581 | 3/1977 | Britton et al. | 405/227 |

*Primary Examiner*—Dennis L. Taylor
*Attorney, Agent, or Firm*—Kenway & Jenney

[57] ABSTRACT

A subsea grout distributor is disclosed for supplying grout sequentially to a plurality of subsea grout-receiving locations from a primary grout supply conduit. The subsea distributor comprises a frame submergible beneath a water surface. A plurality of secondary grout supply conduits have inlet ends secured to the frame and outlet ends communicable with respective ones of the grout receiving locations. A carriage is movably mounted on the frame. A receiver is movably mounted on the carriage and is connectible with an outlet end of the primary grout supply conduit which extends to the water surface. A displacing mechanism is provided for moving the carriage to sequentially position the receiver adjacent the inlet ends of the secondary grout supply conduits. Mechanism is provided for moving the receiver toward an inlet end of a respective one of the secondary grout supply conduits to enable grout to be transferred to the latter from the primary grout supply conduit, and for moving the receiver away from the last-named inlet end, to enable the carriage to be displaced relative thereto.

21 Claims, 12 Drawing Figures

FIG. 1
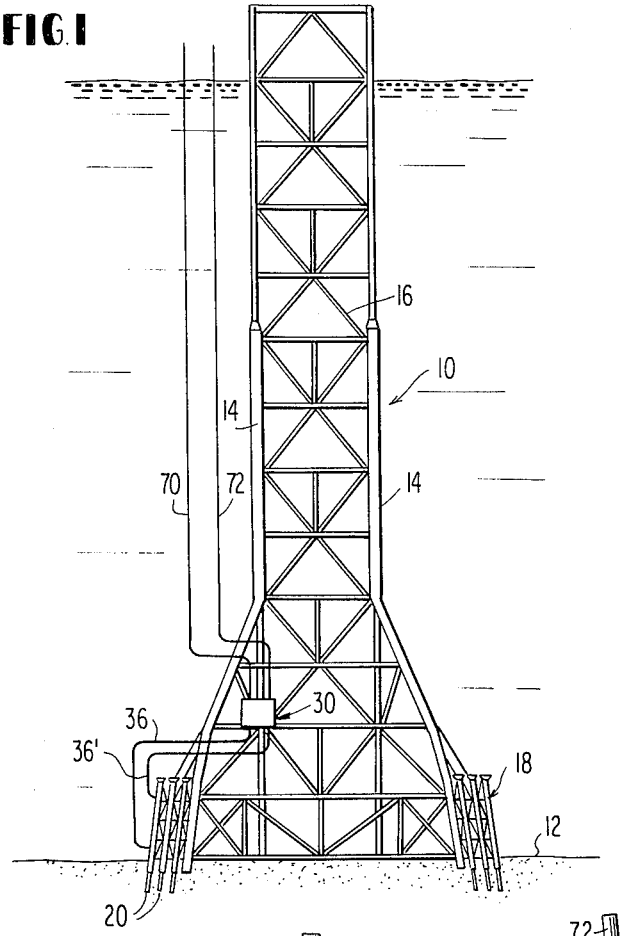
FIG. 6A
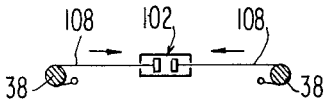
FIG. 6B
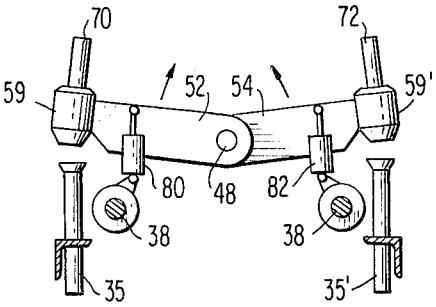
FIG. 6C
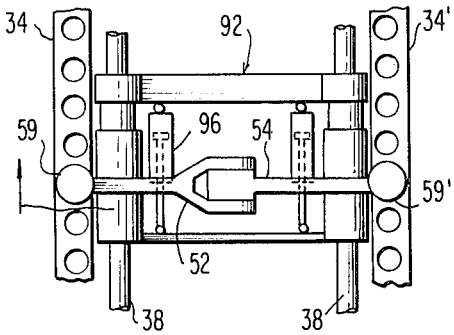
FIG. 6D
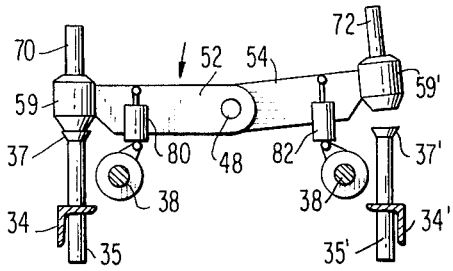
FIG. 6F
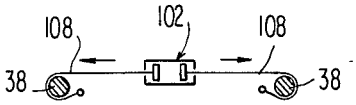
FIG. 6E
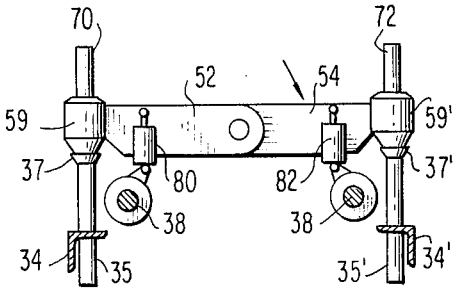
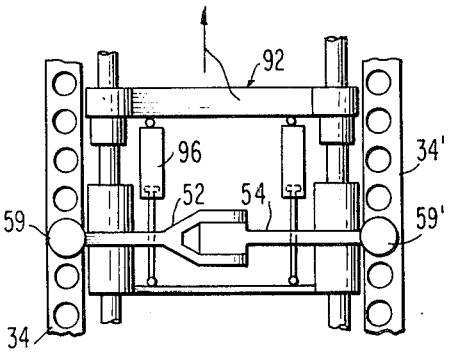
FIG. 6G

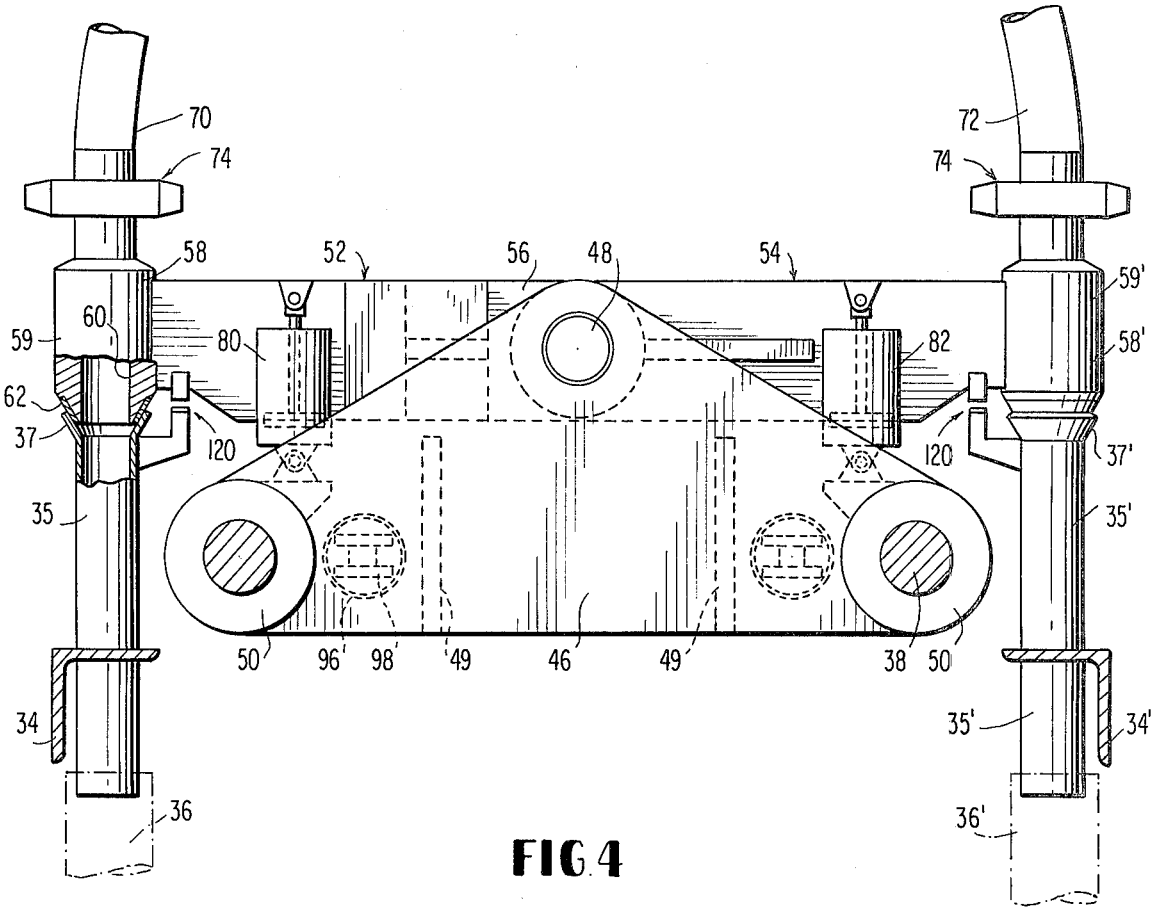
FIG. 4
FIG. 5
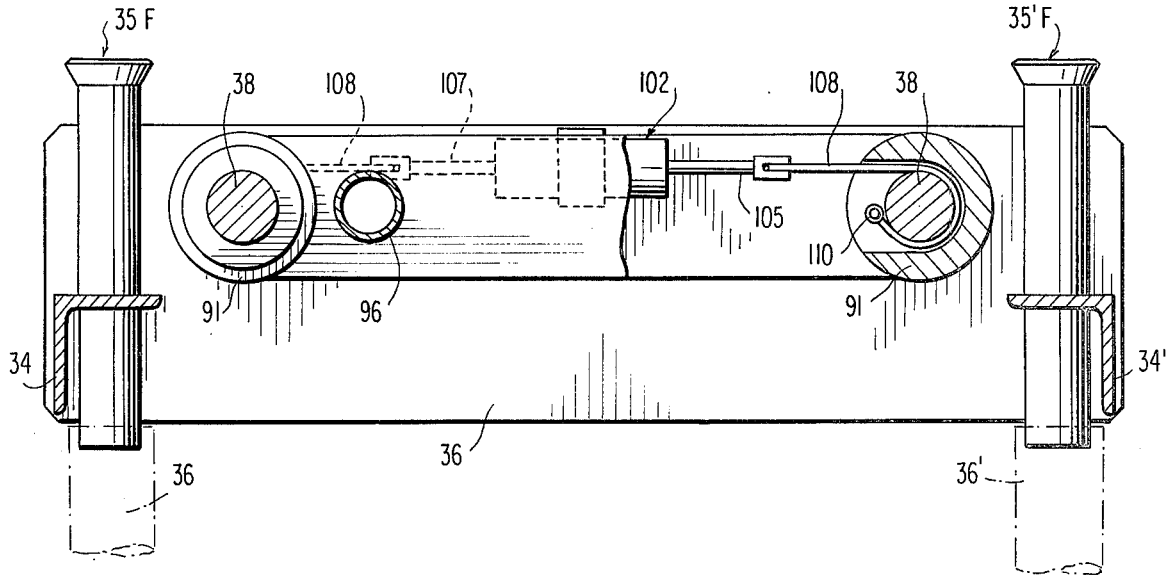

SUBSEA GROUT DISTRIBUTOR

BACKGROUND AND OBJECTS OF THE INVENTION

The present invention relates to the installation of offshore structures such as drilling platforms, and in particular, to the grouting-in-place of support piles which anchor an offshore structure to the seabed.

Offshore structures of the type to be utilized in the drilling of subsea oil or gas wells may comprise a jacket structure which is erected upon the seabed and a platform which is supported upon the jacket above the water surface. Generally, the jacket is fabricated at a land-based facility, then towed in a floating condition to an offshore work site, and thereafter erected within the water and lowered onto the seabed. The jacket may comprise a plurality of legs onto which a platform is mounted above the water surface. At the lower end of each leg a pile sleeve cluster may be provided which comprises a series of pile sleeves through which steel piles can be lowered and driven into the seabed by suitable pile driving equipment actuated from the surface. Pile sleeve clusters of this type are disclosed for example in U.S. Pat. No. 3,987,636 issued to Hruska et al on Oct. 26, 1976 and assigned to the assignee of this invention. The disclosure of that patent is hereby incorporated by reference as if set forth at length herein.

Once the piles have been installed, they are secured in place by introducing grouting into an annulus formed between each pile and its associated sleeve.

Among previously proposed techniques for the grouting of piles is the provision of grout supply and discharge conduits for each pile sleeve. Each supply conduit extends between the platform and a lower end of the associated pile sleeve annulus, and each discharge conduit extends between an upper end of the pile sleeve annulus and the platform. Grout is delivered through the supply conduit to fill the annulus and is then discharged to the surface to indicate that the grouting process has been completed. It will be appreciated that the need to provide two conduits per pile sleeve, each conduit extending to the water surface, adds considerable cost and assemblage time to the fabrication of the jacket.

Another known grouting technique involves a primary grout supply conduit which extends from the water surface to a submerged manifold fixed to the jacket adjacent the pile sleeves. Secondary grout supply conduits extend from separate ports on the manifold to respective pile sleeves. Grout is conducted through the primary conduit and into one of the secondary conduits to which it is connected (via the manifold). Thereafter, a diver manually reconnects the primary supply conduit to another position on the manifold to communicate with another of the secondary supply conduits. In this manner, grout is sequentially delivered to the respective pile sleeves. The pile sleeves can be connected to secondary grout discharge lines which are also connected to the manifold for sequential hook-up with a primary discharge conduit by means of diver manipulation. Alternately, the pile sleeves can be left open at their upper ends, whereby the diver can view the progress of the grouting operation. Such a system exhibits certain shortcomings, especially as regards the need for manipulation by a diver.

Exemplary of various grouting techniques are those described in U.S. Pat. Nos. 3,209,544 issued to Borrmann on Oct. 5, 1965, 3,213,629 issued to Manning on Oct. 26, 1965, 3,492,824 issued to Evans et al on Feb. 3, 1970, 3,878,687 issued to Tragesser, Jr. on Apr. 22, 1975 and 4,009,581 issued to Britton et al on Mar. 1, 1977. The techniques disclosed in those patents are so dissimilar to the present invention that they demonstrate the unobviousness of the latter.

It is, therefore, an object of the present invention to minimize or obviate drawbacks of the type previously noted.

It is another object of the invention to provide novel apparatus for grouting submerged pile sleeves.

It is a further object of the invention to enable submerged pile sleeves to be grouted without the assistance of a diver.

It is an additional object of the invention to provide novel apparatus for grouting submerged pile sleeves which minimizes the needed amount of grouting conduit.

It is still a further object of the invention to provide novel apparatus for grouting submerged pile sleeves in which a mechanized subsea carriage travels in step-by-step fashion along the inlets of a row of secondary grout conduits. A movable arm on the carriage is attached to a primary grout conduit and is actuated to communicate the primary grout supply conduit with a secondary grout conduit.

BRIEF SUMMARY OF THE INVENTION

These and other objects are achieved by a subsea grout distributor for supplying grout sequentially to a plurality of subsea grout-receiving locations from a primary grout supply conduit. The subsea distributor comprises a frame. A plurality of secondary grout supply conduits have inlet ends and outlet ends communicable with respective ones of the grout receiving locations. A movable carriage is provided. A receiver is movably mounted on the carriage and is communicable with an outlet end of the primary grout supply conduit. A displacing mechanism is provided for moving the carriage to sequentially position the receiver adjacent the inlet ends of the secondary grout supply conduits. Mechanism is provided for moving the receiver toward an inlet end of a respective one of the secondary grout supply conduits to enable grout to be transferred to the latter from the primary grout supply conduit, and for moving the receiver away from the last-named inlet end, to enable the carriage to be displaced relative thereto.

THE DRAWING

These and other advantages of the present invention will become apparent from the following detailed description of a preferred embodiment thereof in connection with the accompanying drawings in which like numerals designate like elements and in which:

FIG. 1 is a side elevational view of an offshore jacket embodying the present invention;

FIG. 4 is a vertical cross-sectional view of the grout distributor taken along line 4—4 of FIG. 2, depicting both movable nozzles engaged with respective ones of the secondary grout conduits;

FIG. 5 is a vertical cross-sectional view of a carriage displacing mechanism of the distributor, taken along line 5—5 of FIG. 2, with a portion thereof broken away to expose a brake band component;

FIG. 6A is a schematic view depicting a first step in the operational sequence of the distributor wherein the brake bands are tensioned;

FIG. 6B is a schematic view taken in vertical cross-section depicting a subsequent step in the operational sequence wherein both grout conducting nozzles are moved out of engagement with associated ones of the secondary grout conduits;

FIG. 6C is a schematic plan view depicting another step in the operational sequence wherein the carriage is advanced to a subsequent grouting station;

FIG. 6D is a view similar to FIG. 6B depicting a subsequent step in the operational sequence wherein the grout supply nozzle is lowered into engagement with a secondary grout supply conduit while the grout discharge nozzle remains spaced above its associated secondary grout discharge conduit while grout is backflushed from the primary grout discharge conduit;

FIG. 6E is a view similar to FIG. 6B depicting a subsequent step in the operational sequence wherein the grout discharge nozzle is lowered into engagement with its associated secondary grout discharge conduit;

FIG. 6F is a view similar to FIG. 1 depicting a subsequent step in the operational sequence wherein the brake bands are released; and FIG. 6G is a view similar to FIG. 6C depicting a subsequent step in the operational sequence wherein the carriage displacing mechanism is moved relative to the carriage to a new location.

DETAILED DESCRIPTION OF A PREFERRED EMBODIMENT OF THE INVENTION

Figure 2:
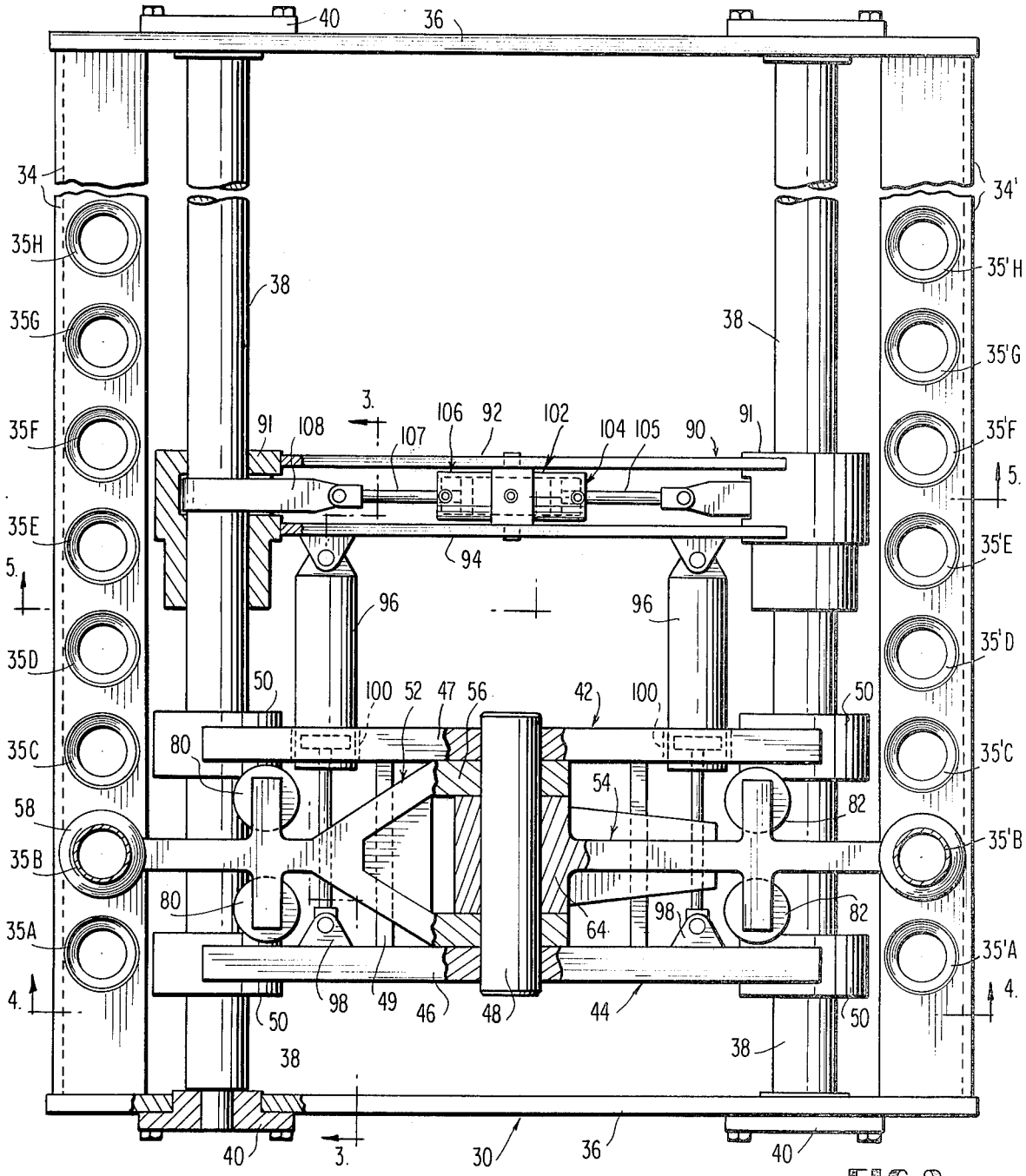
FIG 2 is a plan view of a grout distributor according to the present invention, with parts thereof broken away in horizontal longitudinal section.

In accordance with the present invention an offshore jacket 10 is fabricated and transported in conventional manner to an offshore work site whereupon it is submerged onto the seabed 12. The jacket 10 comprises a plurality of legs 14, reinforcing beams 16, and a cluster of pile jackets 18 disposed adjacent a lower end of each leg 14. The piling jackets are constructed so as to enable piles 20 to be inserted therethrough and driven into the seabed. Attention is directed to U.S. Pat. No. 3,729,940 issued to Albert M. Koehler on May 1, 1973 and assigned to the assignee of this invention for a more detailed description of the jacket 10 and the manner of floating and submerging it.

As described in that patent, grouting is introduced into the annulus formed between the outside wall of each pile and the inside wall of its associated pile sleeve, in order to anchor the pile in place.

In accordance with the present invention, a subsea grout distributor 30 is utilized to efficiently direct grout from a common primary supply conduit to the individual pile sleeves. The grout distributor 30, which is illustrated in detail in FIGS. 2–6, is depicted schematically in FIG. 1 as being fixedly secured to the jacket 10 at a location adjacent the pile sleeves 18, it being understood that the grout distributor 30 can be positioned at any desired location on the jacket, such as directly on the cluster of pile sleeves.

Figure 3:
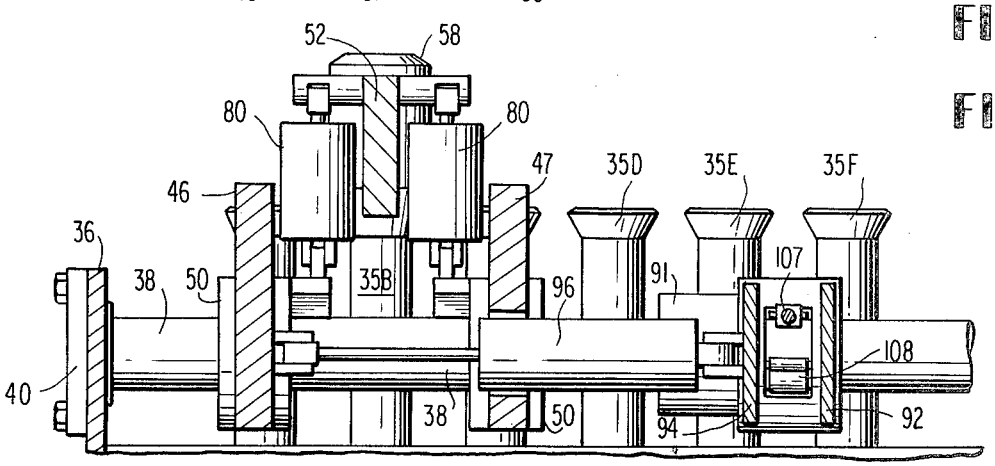
FIG. 3 is a vertical longitudinal sectional view taken along line 3—3 of FIG. 2.

With attention directed to FIGS. 2, 3, and 4, the grout distributor 30 comprises a frame 32 which includes a pair of longitudinal side beams 34, 34' and a pair of end plates 36 that are secured between longitudinal ends of the side beams. Extending from one end plate 36 to the other are a pair of parallel guide rods 38 which each extend fore-to-aft and are fastened at their respective ends to the end plates 36 by means of bearing caps 40.

Supported by one of the side beams 34 is a row of secondary grout supply conduits 35A–H; supported by the other side beam 34' is a row of secondary grout discharge conduits 35'A–H. Each secondary supply conduit 35 and its associated secondary discharge conduit 35' (e.g., supply conduit 35A is associated with discharge conduit 35'A; 35B with 35b'; and so forth) are communicated with one of the pile sleeves 18 in typical fashion, such that the secondary supply conduit communicates with a lower end of the annulus of such pile sleeve and the secondary discharge conduit communicates with an upper end of the annulus. The secondary conduits 35, 35' may, if desired, include flexible conduit portions 36, 36' which are connected to the pile sleeves.

At the upper end of each of the secondary conduits 35, 35' there is disposed a frusto-conically outwardly flared mouth 37, 37'.

As will be appreciated from the following description, the ends 37 of the secondary supply conduits constitute grout inlet ends, while the ends 37' of the secondary discharge conduits constitute grout outlet ends.

Slidably mounted on the guide rods 38 is a grouting carriage 42. The carriage 42 comprises a base 44 which includes a pair of support plates 46, 47 that are interconnected by a pair of fore-to-aft extending braces 49. Extending in a fore-to-aft direction through the support plates 46 is a pin 48. Each of the support plates 46, 47 carries a pair of slide collars 50 which are slidably mounted on the guide rods 38. Situated between the support plates 46, 47 are first and second rocker arms 52, 54.

The rocker arm 52 includes at one end a yoke-shaped mounting portion 56 which is pivotably mounted on the pin 48, and a receiver portion 58 at another end and which is to be connected to an outlet end of the primary grout supply conduit 70. The receiver portion 58 preferably comprises a hollow nozzle-like member 59 having a central channel 60 therethrough. The lower end of the nozzle 59 is of a frusto-conically tapered configuration shaped complimentary to the outwardly flared configuration of the upper ends of each secondary conduit 35, 35'. An inlay 62 of hardened metal may be provided at the taper to form a wear-resistant surface.

The second rocker arm 54 comprises a mounting portion 64 and a receiver portion 58' which is connected to an inlet end of the primary grout discharge conduit 72. The receiver portion 58' is preferably configured similar to that of the first arm 52. That is, the conductor portion 58' includes a hollow nozzle-like member 59' which has a channel therethrough and a tapered lower end.

To the supply nozzle 59 of the first arm 52 is connected a lower end of a primary grout supply conduit 70, and to the discharge nozzle 59' of the second arm 54 is connected a lower end of a primary grout discharge conduit 72. The connection between the primary conduits 70, 72 and the nozzles 59, 59' can be accomplished in any suitable manner, such as by means of conventional clamps 74. The primary conduits 70, 72, which are preferably formed of flexible material, extend upwardly to the water surface. Conventional grout pumping equipment is connected to the primary supply conduit 70 to conduct grout therethrough.

Actuators 80, 82 are provided for pivoting the first and second rocker arms 52, 54, respectively, about a common axis defined by the pin 48. The actuators are preferably in the form of hydraulic rams operated by pressurized fluid supplied from the water surface through suitable conduits. By extending or retracting the rams 80, 82 the arms 52, 54 can be raised or lowered, respectively.

A carriage-displacing mechanism 90 is provided for displacing the carriage 42 along the guide rods 38. The preferred displacing mechanism 90 comprises a pair of collars 91 slidably mounted on the guide rods 38 and a pair of beams 92, 94 interconnecting the guide rods. A pair of actuators 96 in the form of hydraulic rams interconnect one of the beams 94 with the carriage 42, as by being connected to flanges 98 on the support plate 46 located furthest therefrom. The rams 96 extend through openings 100 in the proximately located support plate 47. It will be understood that by extending or retracting the rams 96, relative movement can be effected between the carriage 42 and the displacing mechanism 90.

Mounted on the beams 92, 94 of the carriage-displacing mechanism is a casing 102 which includes at the ends thereof the cylinder portions of a pair of hydraulic rams 104, 106. Rod ends 105, 107 of the rams 104, 106 are each connected to one end of a brake band 108 which is wrapped around one of the guide rods 38. The other end of the brake band is anchored at 110 to the associated collar 91 (FIG. 5). It will be understood that by retracting the rams 104, 106, the brake bands 108 are tensioned and thereby tightened against the guide rods 38 to render the displacing mechanism immovable. By thereafter retracting the rams 96, the carriage 42 can be advanced along the guide rods toward the displacing mechanism. Hence, the carriage can be displaced incrementally in this manner.

In operation, once the jacket 10 has been lowered onto the seabed, and piles have been driven through the pile sleeves 18, connection is made between the discharge end of the primary grout supply conduit 70 and the nozzle 59 of the first arm 52 and between the inlet end of the primary grout discharge conduit 72 and the nozzle 59' of the second arm 54. The sequence of operation of the distributor will now be explained following the grouting of one of the pile sleeves. At such point the nozzle 59 of the first arm 52 engages the flared mouth 37 of a secondary grout supply conduit 35, and the nozzle 59' of the second arm 54 engages the flared mouth 37' of the associated secondary grout discharge conduit 35', such conduits having just been utilized to conduct grout to and from the already-grouted pile sleeve. The hydraulic rams 104, 106 are then actuated to tighten the brake bands 108 against the guide rods 38 (FIG. 6A). Next, the hydraulic rams 80, 82 are extended to raise the nozzles 59, 59' from engagement with the secondary conduits 35, 35' (FIG. 6B). The hydraulic rams 96 are then retracted so as to displace the carriage 42 relative to the guide rods 38 to position the nozzle 59, 59' adjacent a subsequent pair of secondary supply and discharge conduits 35, 35' which are to be next serviced (FIG. 6C).

The hydraulic ram 80 is then retracted to bring the nozzle 59 into contact with the flared mouth 37 of the secondary supply conduit 35 (FIG. 6D). At this point, the nozzle 59' is spaced above the outlet mouth 37' of the secondary discharge conduit 35'. Accordingly, the primary discharge conduit 72 is back-flushed to expel therefrom any residual grout remaining from the previous pile sleeve grouting operation.

Thereafter, the hydraulic ram 82 is retracted to bring the nozzle 59' into engagement with the flared mouth 37' of the secondary discharge conduit 35' (FIG. 6E).

At this juncture, the grouting operation can be peformed by transferring grout through the primary supply conduit 70, the nozzle 59, the secondary grout supply conduit 35, into the associated pile sleeve annulus. Eventually, when the annulus has been filled, excess grout will be displaced through the secondary discharge conduit 55', the nozzle 59' and the primary grout discharge conduit 72 to the water surface. Upon detection of grout at the water surface, the supply of grout will be terminated.

Thereafter, the carriage 42 is moved to a subsequent grouting position by initialling loosening the brake bands 108 from the guide rods 38 (FIG. 6F), and extending the hydraulic rams 96 so as to displace the beam 92 away from the carriage. Since the nozzles 59, 59' are in engagement with the respective flared mouths 37, 37', the carriage will be held stationary, allowing the hydraulic rams 96 to displace the beam 92.

Thereafter, the brake bands 108 are tightened against the guide rods 38 as described earlier in connection with FIG. 6A, and the grouting procedure is repeated.

SUMMARY OF MAJOR ADVANTAGES AND SCOPE OF THE INVENTION

It will be appreciated that in accordance with the present invention the grouting of a plurality of subsea pile sleeves may be achieved through the use of a single pair of primary grout supply and discharge conduits, and without the need for any substantial diver actuation. This serves to reduce the cost of fabricating the jacket and reduces the labor needed in effecting the grouting operation. The grouting distributor can be operated solely by remote control from the water surface and need not rely upon diver assistance.

It may be advantageous to locate the grout distributor above the water surface since it would still provide the advantage of a mechanized distribution of grout to the subsea locations.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A grout distributor for supply grout sequentially to a plurality of subsea grout-receiving locations from a primary grout supply conduit means, said distributor comprising:

a plurality of secondary grout supply conduit means having inlet ends and outlet ends communicable with respective ones of said grout receiving locations, a movable carriage, receiver means movably mounted on said carriage and being communicable with an outlet end of the primary grout supply conduit means, means for moving said carriage to sequentially position said receiver means adjacent said inlet ends of said secondary grout supply conduit means, and means for moving said receiver means:

toward an inlet end of a respective one of said secondary grout supply conduit means to enable grout to be transferred to the latter from said primary grout supply conduit means, and away from said last-named inlet end, to enable said carriage to be displaced relative thereto.

2. Apparatus according to claim 1, wherein said receiver means comprises a nozzle having a channel therethrough, said nozzle being connectible to said outlet end of said primary grout supply conduit means with the latter being aligned with said channel.

3. Apparatus according to claim 2, including an arm pivotably mounted at an inner end thereof to said carriage, said receiver means being carried at an outer end of said arm.

4. Apparatus according to claim 3, wherein said means for moving said receiver means comprises fluid motor means mounted on said carriage and connected to said arm.

5. Apparatus according to claim 2, wherein an outlet end of said nozzle is tapered, and said inlet ends of said secondary grout supply conduit means being outwardly flared in complimentary relationship to said tapered end of said nozzle.

6. Apparatus according to claim 1, including a submersible frame, said inlet ends of said secondary conduits being connected to said frame, said frame including guide means, said carriage being slidably mounted on said guide means; said means for moving said carriage comprising a displacing member slidably mounted on said guide means, brake means on said displacing member for selectively fixing the latter against movement relative to said guide means, and motor means operably interconnecting said displacing member and said carriage to move the frame away from the latter when said brake means is deactivated while said receiver means is positioned against an inlet end of one of said secondary conduit means, and to move said carriage toward said displacing member when said brake means is activated while said receiver means is positioned away from said last-named outlet end.

7. Apparatus according to claim 6, wherein said brake means comprises a brake band, and said last-named motor means comprises a fluid actuated ram.

8. Apparatus according to claim 1, including a plurality of secondary grout discharge means having outlet ends and inlet ends communicable with respective ones of said grout receiving locations, an additional receiver means movably mounted on said carriage and being connectible with an inlet end of a primary grout discharge conduit means, said means for moving said carriage also being operable to sequentially position said additional receiver means adjacent said outlet ends of said secondary grout discharge conduit means, and further including means for moving said additional receiver means toward an outlet end of a respective one of said secondary grout discharge conduit means to enable grout to be transferred from the latter to said primary grout discharge conduit means, and for moving said additional receiver away from said last-named outlet end to enable said carriage to be displaced relative thereto.

9. Apparatus according to claim 8, wherein said first-named receiver means and said additional receiver means are movable independently of one another.

10. Apparatus according to claim 9, wherein said first-named receiver means and said additional receiver means each comprise a nozzle having a channel running therethrough, a pair of arms being mounted at inner ends thereof to said carriage for rotation about a common pivot axis, said nozzles being carried at outer ends of respective ones of said arms.

11. In a jacket structure of the type seated on a seabed and supporting a work platform above the water surface, said jacket comprising a plurality of pile sleeves for receiving anchoring piles therethrough for anchoring the jacket to the seabed, said pile sleeves each including an entance port communicating with an annulus formed between the pile sleeve and its associated pile for conducting grout to said annulus from a primary grout supply conduit means extending to the water surface, and an exit port communicating with said annulus for discharging grout therefrom to be conducted to the water surface through a primary grout discharge conduit means, the improvement comprising subsea grout distributor means for communicating said primary grout supply and discharge conduit means sequentially with said plurality of pile sleeves, said grout distributor means comprising:

frame means mounted at a submerged location on said jacket structure, a plurality of secondary grout supply conduit means having inlet ends secured to said frame means and outlet ends communicating with said entrance ports of respective ones of said pile sleeves, a plurality of secondary grout discharge conduit means having outlet ends secured to said frame means and inlet ends communicating with said exit ports of respective ones of said pile sleeves, a carriage movably mounted on said frame means, first receiver means movably mounted on said carriage and connectible with an outlet end of said primary grout supply conduit means, second receiver means movably mounted on said carriage and connectible with an inlet end of said primary grout discharge conduit means, means for moving said carriage relative to said frame means to sequentially position said first and second receiver means adjacent said inlet and outlet ends of said secondary grout supply and discharge conduit means, respectively, means for moving said first receiver means toward said inlet end of an associated one of said secondary grout supply conduit means, to enable grout to be transferred to the latter from said primary grout supply conduit means, and away from said last-named inlet end to enable said carriage to be displaced relative thereto, and means for moving said second receiver means toward said outlet end of an associated one of said secondary grout supply conduit means, to enable grout to be transferred to said primary grout discharge conduit means from said secondary grout discharge conduit means, and away from said last-named outlet end, to enable said carriage to be displaced relative thereto.

12. Apparatus according to claim 11, wherein each of said receiver means comprises a nozzle having a channel therethrough.

13. Apparatus according to claim 12, including a pair of arms pivotably mounted at inner ends thereof to said carriage, said nozzles being carried at outer ends of respective ones of said arms.

14. Apparatus according to claim 13, wherein said arms are pivotably connected to said carriage for pivotal movement about a common pivot axis.

15. Apparatus according to claim 14, wherein said means for moving said first and second receiver means comprises fluid motor means mounted on said carriage and connected to said arms.

16. Apparatus according to claim 12, wherein each of said nozzles includes a lower end which is tapered inwardly, said inlet ends of said secondary grout supply conduit means being outwardly flared in complimentary relationship to said tapered end of said first nozzle, said outlet end of said secondary grout discharge conduit means being outwardly flared in complimentary relationship to said tapered end of said second nozzle member.

17. Apparatus according to claim 11, wherein said frame means comprises guide means; said carriage being slidable onto said guide means; said means for moving said carriage comprising a displacing member slidably mounted on said guide means, brake means on said displacing member for selectively fixing the latter against movement relative to said guide means, and motor means operably interconnecting said displacing member and said carriage to move the former away from the latter when said brake means is deactivated and said first and second receiver means are positioned against said secondary conduit means, and to move said carriage toward said displacing member when said brake means is activated and said first and second receiver means are positioned away from said secondary conduit means.

18. Apparatus according to claim 6, wherein said brake means comprises a brake band, and said last-named motor means comprises a fluid-actuated ram.

19. Apparatus according to claim 11, wherein said first and second receiver means are movable independently of one another.

20. In a jacket structure of the type seated on a seabed and supporting a work platform above the water surface, said jacket comprising a plurality of pile sleeves for receiving anchoring piles therethrough for anchoring the jacket to the seabed, said pile sleeves each including an entrance port communicating with a lower end of an annulus formed between the pile sleeve and its associated pile for conducting grout to said annulus from a primary grout supply conduit means extending to the water surface, and an exit port communicating with an upward end of said annulus for discharging grout therefrom to be conducted to the water surface through a primary grout discharge conduit means, the improvement comprising subsea grout distributor means for communicating said primary grout supply and discharge means sequentially with said plurality of pile sleeves, said grout distributor means comprising:

frame means mounted at a submerged location on said jacket structure, a plurality of secondary grout supply conduit means having outwardly flared inlet ends secured to said frame means and outlet ends communicating with said entrance ports of respective ones of said pile sleeves, a plurality of secondary grout discharge conduit means having outwardly flared outlet ends secured to said frame means and inlet ends communicating with said exit ports of respective ones of said pile sleeves, guide means on said frame means, a carriage slidably mounted on said guide means, a pair of arms pivotably mounted at inner ends thereof to said carriage for independent pivotable movement about a common pivotal axis, a grout supply nozzle disposed at an outer end of a first of said arms, said grout supply nozzle including:

an inlet end connected with an outlet end of said primary grout supply conduit means, and an outlet end tapered complimentarily to said outwardly flared ends of said secondary grout conduit means, motor means for moving said carriage relative to said frame means to sequentially position said grout supply and discharge nozzles adjacent said inlet and outlet ends of said secondary grout supply and discharge conduit means, respectively, motor means for rotating said first arm about said common pivot axis to bring said grout supply nozzle:

into engagement with said inlet end of an associated one of said secondary grout supply conduit means, to enable grout to be transferred to the latter from said primary grout supply conduit means, and out of engagement with said last-named inlet end to enable said carriage to be displaced thereto, and motor means for pivoting said second arm about said common pivot axis to bring said grout discharge nozzle:

into engagement with said outlet end of an associated one of said secondary grout supply conduit means, to enable grout to be transferred to said primary discharge conduit means from said secondary grout discharge conduit means, and out of engagement with said last-named outlet end to enable said carriage to be displaced relative thereto.

21. A method of supplying grout sequentially to a plurality of subsea grout-receiving locations from a primary grout supply conduit, comprising the steps of:

(a) providing a plurality of secondary grout supply conduits, said secondary conduits including inlet ends and outlet ends connected to respective ones of said subsea grout receiving locations, (b) moving a carriage relative to said inlet ends to sequentially position receiver means on said carriage adjacent said inlet ends, said primary conduit being connected to said receiver means, (c) moving said receiver means relative to said carriage toward the inlet end of a respective one of said secondary conduits to align said primary conduit with said respective secondary conduit, (d) transferring grout from said primary conduit into said respective secondary conduit, (e) thereafter moving said receiver means relative to said carriage away from said respective secondary conduit, (f) subsequently moving said carriage to a position wherein said receiver means is disposed adjacent another of said secondary conduits, and (g) repeating steps (c), (d) and (e) relative to said other conduit.

* * * * *